US009347343B2

(12) United States Patent
Zoppi et al.

(10) Patent No.: US 9,347,343 B2
(45) Date of Patent: May 24, 2016

(54) GASKET FOR A VALVE OF AN INTERNAL-COMBUSTION ENGINE

(71) Applicant: FREUDENBERG SEALING TECHNOLOGIES S.A.S. DI EXTERNA ITALIA S.R.L.U, Pinerolo (TO) (IT)

(72) Inventors: Claudio Zoppi, Pinerolo (IT); Andrea Giordano, Pinerolo (IT); Paolo Fervier, Pinerolo (IT); Daniele Bordabossana, Pinerolo (IT)

(73) Assignee: FREUDENBERG SEALING TECHNOLOGIES S.A.S. DI EXTERNA ITALIA S.R.L.U. (IT)

( * ) Notice: Subject to any disclaimer, the term of this patent is extended or adjusted under 35 U.S.C. 154(b) by 0 days.

(21) Appl. No.: 14/302,932

(22) Filed: Jun. 12, 2014

(65) Prior Publication Data

US 2015/0123352 A1 May 7, 2015

(30) Foreign Application Priority Data

Nov. 4, 2013 (IT) ..... TO2013A0894

(51) Int. Cl.
*F01L 3/08* (2006.01)

(52) U.S. Cl.
CPC ..... *F01L 3/08* (2013.01); *F01L 2101/00* (2013.01)

(58) Field of Classification Search
CPC ..... F01L 3/08
USPC ..... 277/502
See application file for complete search history.

(56) References Cited

U.S. PATENT DOCUMENTS

| | | | | |
|---|---|---|---|---|
| 4,928,644 | A | 5/1990 | Travis | |
| 8,235,394 | B2 * | 8/2012 | Sakata | 277/502 |
| 2004/0104537 | A1 | 6/2004 | McArthy | |
| 2005/0040603 | A1 * | 2/2005 | Leimer | 277/502 |
| 2008/0157480 | A1 * | 7/2008 | Scarano | 277/402 |

FOREIGN PATENT DOCUMENTS

| | | | | |
|---|---|---|---|---|
| CA | 2372019 A1 * | 8/2002 | | F01L 3/08 |
| EP | 2236776 | 10/2010 | | |
| EP | 2253809 | 11/2010 | | |
| IT | EP 0750097 A1 * | 12/1996 | | F01L 3/08 |

OTHER PUBLICATIONS

Italian Search Report dated Jun. 6, 2014.

* cited by examiner

*Primary Examiner* — Kristina Fulton
*Assistant Examiner* — L. Susmitha Koneru
(74) *Attorney, Agent, or Firm* — The Belles Group, P.C.

(57) ABSTRACT

Described herein is a gasket for a valve of an internal-combustion engine; the valve comprises at guide element defining a through seat, find a stein slidably mobile in said seat; the gasket comprises an annular sealing element, which is elastically deformable and is designed to be set externally on the valve to co-operate both with the guide element and with the stem, and an annular supporting member, which is set coaxially on at least part of the sealing element in such a way that the latter is radially pressed between the supporting member and the valve; the supporting member comprises a first portion for interaction with the sealing element and a second portion for positioning in use the gasket on the engine; the first and second portions of the supporting member form part of a first component and a second component respectively, that are distinct from one another and are mounted coaxially by snap-action coupling means.

16 Claims, 3 Drawing Sheets

GASKET FOR A VALVE OF AN INTERNAL-COMBUSTION ENGINE

CROSS REFERENCE TO RELATED APPLICATIONS

Priority is claimed, under 35 U.S.C. §119, to Italian patent application No. TO2013A 000894, filed Nov. 4, 2013, the disclosure of which is incorporated herein by reference in its entirety.

FIELD OF THE INVENTION

The present invention relates to a gasket for a valve of an internal-combustion engine.

BACKGROUND OF THE INVENTION

Known to the art are internal-combustion engines for vehicles comprising a head bearing one or more cylinders, inside which the engine cycle takes place and which are set in communication with respective combustion chambers of the engine itself. Moreover provided on the aforesaid head are appropriate seats designed to enable communication of the combustion chamber with ducts designed to send into said chamber a mixture of unburnt fuel and air (intake ducts) and to remove the burnt gases from said combustion chamber (exhaust ducts).

The flows from and to each combustion chamber are controlled by appropriate valves that act on the aforesaid seats. In particular, each valve basically comprises a guide element fixed within a cavity of the engine head and a stem, which is slidably mobile in opposite directions within a through seat defined by the guide element and carries at one end an open/close portion for closing the connection between the corresponding intake or exhaust duct and the corresponding combustion chamber.

The opposite end of the stem of the valve projects axially from the corresponding guide element and is designed to receive actuation forces from a corresponding, control device, for example a camshaft.

The stem of the valve is axially loaded by a cylindrical helical spring in the direction of closing of the connection between the corresponding intake or exhaust duct and the corresponding combustion chamber.

In particular, the spring is mounted coaxially around the valve and is axially set between a fixed surface made on the engine head and a cap fixed to the stem of the valve in the proximity or at the end of the stem itself that co-operates with the control device.

Normally mounted on the valves of the type described above are seal gaskets for the lubricating oil normally circulating in engines. Said gaskets, in one of the most widely known forms, comprise a supporting or reinforcement member, which has a substantially tubular conformation and is made of a single piece of metal material, and an annular sealing element, which is made of elastomeric material and is set between the supporting member and the valve.

In particular, the sealing element typically comprises a first portion designed to co-operate, via an inner radial surface of its own, with the outer radial surface of the portion of the guide element facing in use the aforesaid control device, and a second portion designed to co-operate directly with the stem of the valve.

Gaskets of the type described above are widely used in all internal-combustion engines for control of the amount of lubricating oil that from the distribution area flows towards the combustion chambers. An excessive flow of lubricating oil causes, in addition to an evident excessive consumption of the oil itself, a deterioration of the efficiency of the engine and a reduction of the performance of the catalytic converter of the vehicle. On the other hand, an insufficient flow brings about an increase of wear and noise of the valves accompanied by the presence of local temperature peaks. These phenomena may cause a premature damage to the valves following upon seizing of the stem of the valves themselves within the guide element.

Known gaskets, via the first portion of the sealing element acting on the guide element of the corresponding valve, provide a seal of a static type, and, via the second portion of the sealing element co-operating with the stem, provide a seal of a dynamic type. In particular, the static seal must ensure a certain degree of radial compression on the guide element in order to prevent leakage of lubricating oil towards the combustion chambers and at the same time hold in position the gasket itself, whereas the dynamic seal is designed to enable the minimum flow of oil necessary for lubrication of the coupling between the stem and the guide element.

The supporting member comprises:

- a substantially cylindrical main portion;
- a first annular flange, which extends radially inwards from an axial end of the main portion and is in part embedded in an annular seat of the sealing element; and
- a second annular flange, which extends radially outwards from an opposite axial end of the main portion and is designed to be pushed against the aforementioned fixed surface of the engine head by the spring acting on the stem of the valve.

In practice, the second annular flange of the supporting member defines a contrast surface for an axial end of the spring and receives from the latter the normal operating loads.

The second annular flange moreover enables the gasket to be brought into action in the desired position on the valve.

There is felt in the sector the need to provide gaskets that are able to control effectively the flow of lubricating oil towards the combustion chambers and that are, at the same time, of lower cost, lower weight and greater constructional simplicity as compared to solutions of a known type, in particular in the case of use on engines of large dimensions.

SUMMARY OF THE INVENTION

The aim of the present invention is to provide a gasket for a valve of an internal-combustion engine that will enable, in a simple and inexpensive way, at least one of the needs specified above to be met.

The aforesaid aim is achieved by the present invention, in so far as it regards a gasket for a valve of an internal-combustion engine according to what is defined in claim 1.

BRIEF DESCRIPTION OF THE DRAWINGS

For a better understanding of the present invention a preferred embodiment is described in what follows, purely by way of non-limiting example and with reference to the attached drawings, wherein.

DETAILED DESCRIPTION OF THE INVENTION

Figure 1:
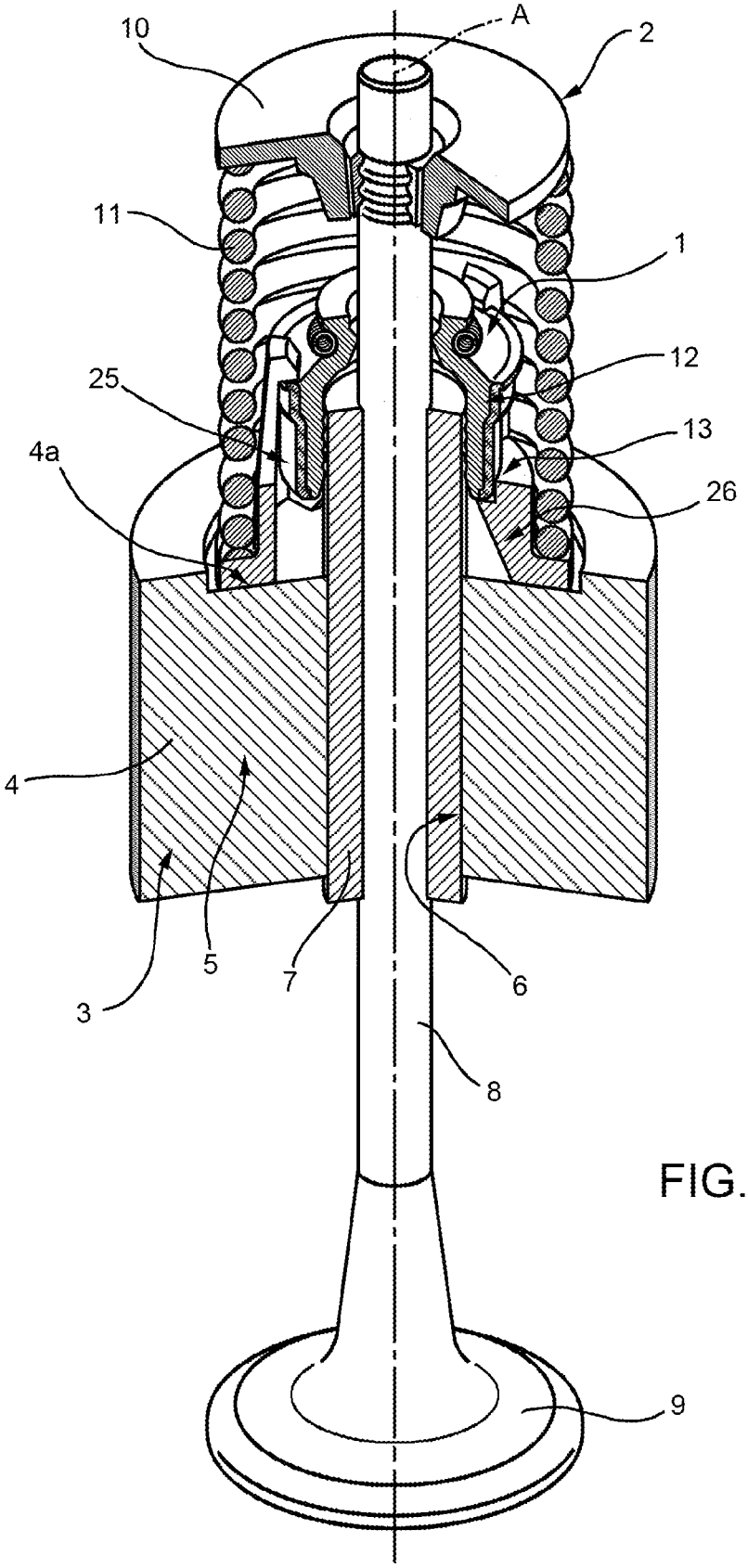
FIG. 1 is a perspective view in partial cross section of a portion of an internal-combustion engine provided with a gasket with axial symmetry for a valve made according to the teachings of the present invention.

With reference to the attached figures, designated as a whole by 1 is a gasket according to the present invention for a valve 2 of an internal-combustion engine 3, in itself known and illustrated in FIG. 1 only as regards what is necessary for an understanding of the present invention.

In greater detail, in FIG. 1 the engine 3 is illustrated limitedly to a portion 4 of a head 5, which defines in a known way a combustion chamber (not visible in FIG. 1 but set underneath the portion 5 of the head 4 illustrated), inside which a fuel is oxidized in the presence of combustion air so as to convert the chemical energy contained in the fuel into pressure energy.

The combustion chamber receives in a known way, through an opening of its own, a mixture comprising the fuel and the combustion air and discharges, through another opening, the burnt gas and air at the end of the combustion process.

The flows from and to the combustion chamber are controlled by respective valves 2 of the type recalled above, which act on the aforementioned openings of the combustion chamber itself.

The ensuing description will make reference for simplicity to just one valve 2, it remaining understood that the same characteristics described are present in any valve of this type used in the engine 3.

Figure 3:
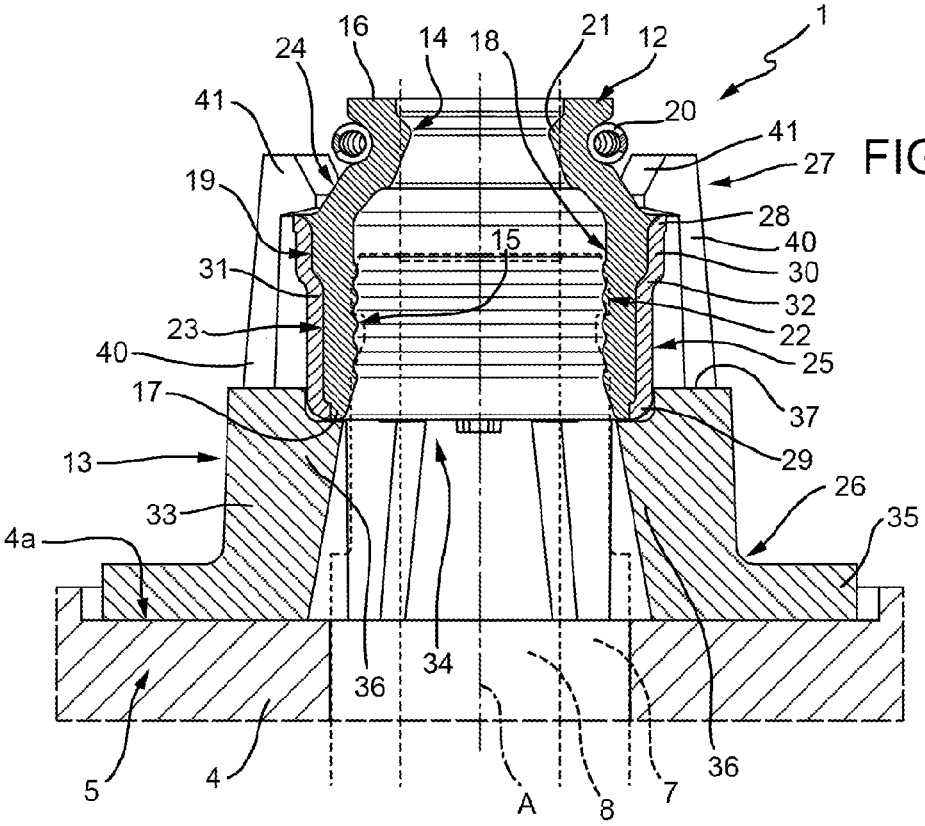
FIGS. 3 and 4 are sections taken along various diametral planes of the gasket of FIG. 1.
Figure 4:
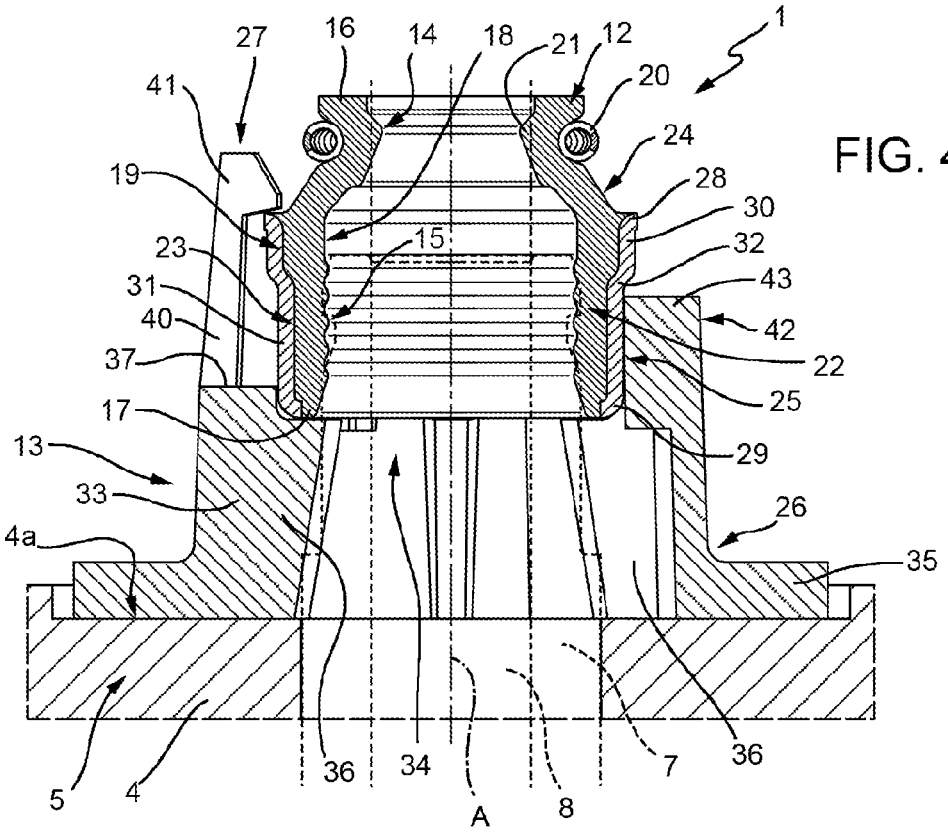

With reference to FIGS. 1, 3, and 4, the valve 2 is housed in a through seat 6, which is made in the portion 5 of the head 4 and normally contains lubricating oil.

The valve 2 comprises a tubular guide element 7 interference fitted within the seat 6, and a stem 8 slidably mobile in opposite directions along the axis A inside the guide element 7.

In greater detail, the stem 8 projects from opposite sides of the guide element 7 and is provided, at its own opposite axial ends, respectively with an open/close element 9, which is designed to engage in a fluid-tight way the corresponding opening in the combustion chamber, and with an actuation element or cap 10, which is designed to receive actuation forces from a control mechanism, in itself known and not illustrated, for example a camshaft.

Fitted on the outside of the axial end portion of the guide element 7, from which the end of the stem 8 provided with the cap 10 projects, is a corresponding gasket 1 according to the invention, which surrounds coaxially both the guide element 7 and the stem 8.

The valve 2 further comprises a spring 11, in the case in point illustrated of a helical type, which co-operates, at opposite axial ends thereof, with the cap 10 and with a part of the gasket 1 (described in greater detail in what follows) axially pressed against a fixed annular surface 4*a* of axis A of the portion 4 of the head 5.

The spring 11 is designed to generate an elastic restoring force on the stem 8 such as to keep it always in contact, in a position corresponding to the open/close element 9, with the control mechanism.

Figure 2:
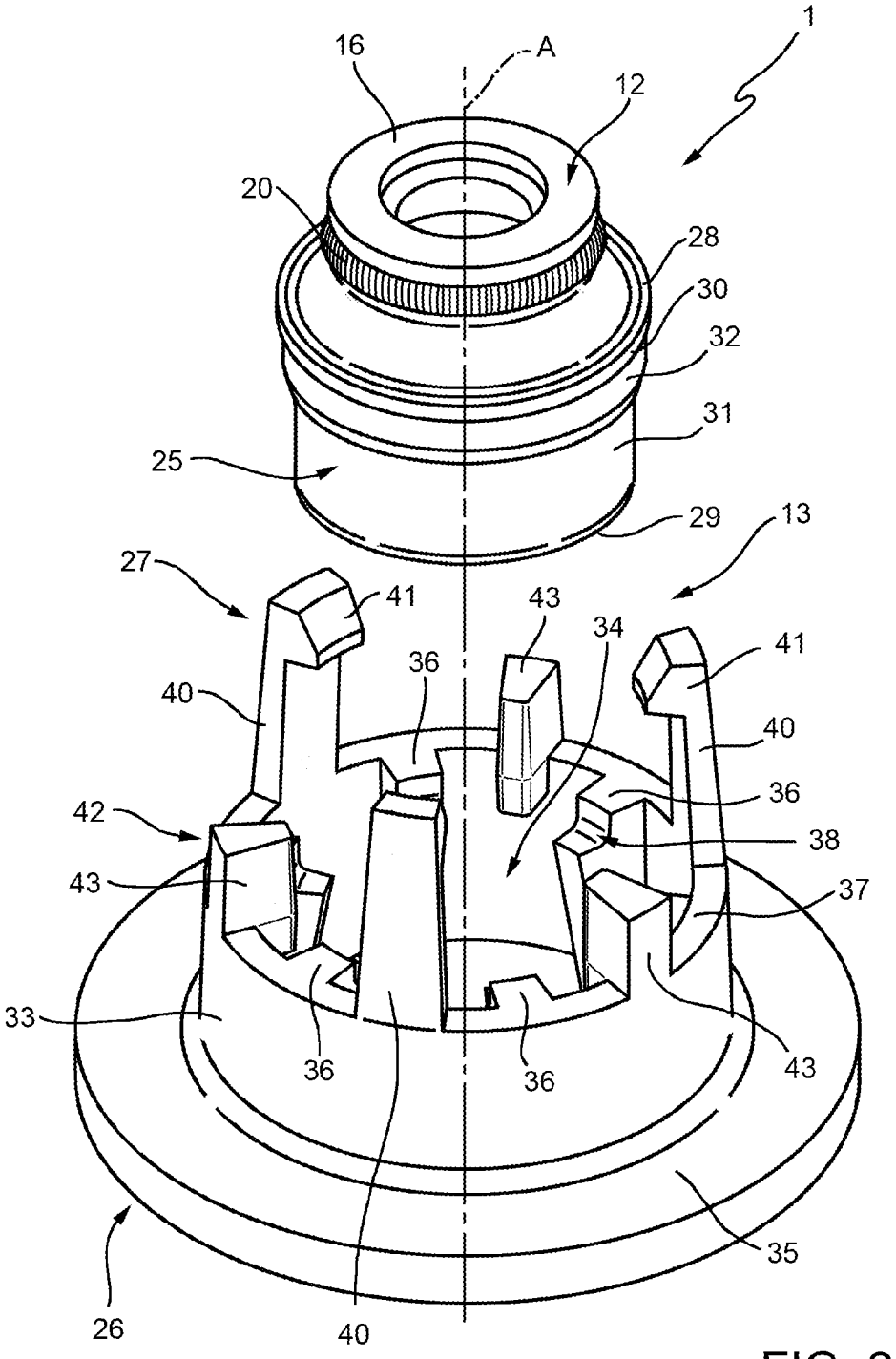
FIG. 2 is an exploded perspective view at an enlarged scale of the gasket of FIG. 1.

With particular reference to FIGS. 2 to 4, the gasket has an annular conformation around an axis coinciding, in the assembled condition, with the axis A.

More precisely, the gasket 1 basically comprises a sealing element 12, which has an annular shape and is made of elastomeric material, and a supporting member 13, which is set coaxially on the sealing element 12 so as to press the latter, in a radial direction with respect to the axis A, on the guide element 7 and on the stem 8 of the valve 2. In practice, the sealing element 12 is set coaxially between the supporting member 13 and the valve 2.

The sealing element 12 defines, proceeding along the axis A in the direction of the open/close element 9 of the stem 8, first a seal 14 of a dynamic type designed to enable passage of a minimum flow of oil necessary for lubrication of the coupling between the stem 8 and the guide element 7, and then a seal 15 of a static type for preventing flow of oil towards the combustion chamber.

In greater detail, the sealing element 12 is delimited by two axial-end disk-shaped sections 16, 17, opposite to one another, by an inner circumferential surface 18 designed to co-operate in part with the stem 8 and in part with the guide element 7 to provide the seals 14 and 15, and by an outer circumferential surface 19 designed to couple with the supporting member 13 and with an annular elastic collar 20 so as to press the inner circumferential surface 18 on the stem 8.

In the assembled condition, the section 16 faces the control mechanism and is traversed by the stem 8; in the assembled condition, the section 17 faces the combustion chamber, and is traversed both by the stem 8 and by the guide element 7.

The inner circumferential surface 18 of the sealing element 12 comprises, in a position adjacent to the section 16, a section 21 of minimum diameter, designed to be pressed radially by the elastic collar 20 against the stem 8 so as to define a circumferential seal line of a dynamic type (seal 14), which enables, thanks to the slidable coupling with the stem 8 itself exit of a minimal flow of oil.

The inner circumferential surface 18 of the sealing element 12 further comprises, in a position adjacent to the section 17, a substantially cylindrical portion 22 with small undulations, designed to be pressed radially by the supporting member 13 against the guide element 7 so as to define a cylindrical seal area of a static type (seal 15).

The outer circumferential surface 19 comprises a first, substantially cylindrical, portion 23, which is opposite to the portion 22 of the inner circumferential surface 18 and is designed to co-operate with the supporting member 13, and a second portion 24, which exits from the supporting member 13 and co-operates with the elastic collar 20.

The supporting member 13 is advantageously formed by two distinct annular components 25, 26, mounted coaxially with respect to one another by snap-action coupling means 27.

In particular, the radially innermost component 25 co-operates in use with the sealing element 12 so as to press it radially on the guide element 7 of the valve 2, whereas the component 26 is mounted in a radially outermost position on the component 25 and is designed to be positioned in use on the fixed surface 4*a* of the portion 4 of the head 5 of the engine 3 by the action of the spring 11 of the valve 2.

In practice, the component 25 defines a portion of interaction of the supporting member 13 with the sealing element 12, whereas the component 26 defines a portion of positioning of the supporting member 13 itself on the portion 4 of the head 5 of the engine 3 and with respect to the guide element 7 of the valve 2. The component 26 is designed to receive in use operating loads from the spring 11 of the valve 2 and to bring the gasket 1 into the desired position on the valve 2.

The component 25 is preferably made of metal material and has a substantially cylindrical shape extending along the axis A; in particular, the component 25 co-operates with the portion 23 of the outer circumferential surface 19 of the sealing element 12 and basically comprises:

an axial end stretch 28, which is slightly bent radially outwards with respect to the axis A and from which the portion 24 of the outer circumferential surface 19 of the sealing element 12 projects;

an opposite axial end stretch 29, which is bent in the direction of the axis A so as to withhold the sealing element 12 axially in a position corresponding to the section 17 of the latter;

a first cylindrical stretch 30, which extends from the axial end stretch 28; and a second cylindrical stretch 31, which extends from the axial end stretch 29 and has an outer diameter smaller than the outer diameter of the cylindrical stretch 30 and radiused to the latter by means of a conical connection stretch 32.

In practice, die component 25 presents a radial encumbrance that increases along the axis A, from its own axial end stretch 29 to its own opposite axial end stretch 28.

The component 26 is made of plastic material. Preferably, the component 26 may be made of thermoplastic material with high performance and excellent mechanical properties and properties of thermal resistance, that is able to assume the functions of metal materials in applications of a static and dynamic type. The thermoplastic material constituting the component 26 may or may not be reinforced with appropriate agents, for example of an organic or inorganic type.

The component 26 basically comprises a main cylindrical body 33, designed to define a seat 34 for receiving the component 25, and a plane annular end flange 35, which projects radially outwards from the main body 33 and is designed to co-operate by hearing upon the fixed surface 4*a* of the portion 4 of the head 5 of the engine 3 under the axial thrust of the spring 11 of the valve 2.

The main body 33 has a plurality of projections 36 that project radially inwards and have, in the proximity of an end edge 37 of the main body 33 itself opposite to the flange 35, respective shoulders 38 designed to define respective contrast snakes for the axial end stretch 29 of the component 25.

The snap-action coupling means 27 are defined by a plurality of engagement lances 40, in the case in point illustrated three, which project, in the undeformed position, in a direction parallel to the axis A from the end edge 37 of the main body 33, are set at the same angular distances apart from one another about the axis A itself, and are elastically flexible away from and towards the component 25 so as to engage it or possibly release it.

In particular, each engagement lance 40 carries, at its own free end, a tooth 41 designed to couple by snap-action with the axial end stretch 28 of the component 25.

Finally, the component 26 comprises means 42 for positioning the component 25 in its own seat 34. The positioning means 42 basically comprise a plurality of projections 43, in the case in point illustrated three, which project from the main body 33 both radially towards the inside of the body 33 itself and in a direction parallel to the axis A starting from the end edge 37. The projections 43 have an axial height smaller than that of the engagement lances 40 and are set at the same angular distances apart from one another about the axis A. Each projection 43 is moreover angularly set between two engagement lances 40 with reference to the axis A.

The projections 43 are designed to co-operate in use with the cylindrical stretch 31 of the component 25.

From an examination of the characteristics of the gasket 1 provided according to the teachings of the present invention, the advantages that it affords are evident.

In particular, thanks to the fact that the two main functions of the supporting member 13—i.e., the function of interaction with the sealing element 12 and of pressure thereon and the function of positioning on the head 4 of the engine 3—are performed by distinct components 25, 26, it is possible to make the component 26 that performs the fixing function of plastic material.

In this way, as compared to gaskets of a known type, a considerable reduction of overall weight and cost of the gasket 1 and a greater flexibility in the geometrical configuration of the component 26 of plastic material are obtained.

In greater detail, it could be envisaged to use substantially the same component 25 that acts on the sealing element 12 for the various types of engines 3 and to vary, instead, according to the specific geometry of the engine 3 on which the gasket 1 is to be mounted, the configuration of the other component 26 of plastic material. It is precisely the fact of using a plastic material that enables a considerable ease of moulding of the latter component in a wide range of shapes, which are usually not possible in the case of metal materials. A wide adaptability to the various engines, above all those of large dimensions, is thus obtained.

Moreover, providing fixing between the components 25 and 26 by snap-action coupling means 27 prevents any undesirable sliding between metal materials during assembly with possible generation of scraps.

Finally, the snap-action coupling means 27 enable high retention forces with low assembly loads.

Finally, it is clear that modifications and variations may be made to the gasket described and illustrated herein, without thereby departing from the sphere of protection of the present invention defined by the annexed claims.

In particular, also the component 25 could be made of plastic material.

What is claimed is:

1. A gasket apparatus for sealing a valve of an internal-combustion engine, said valve comprising a guide element defining a through seat, and a stem slidably mobile in said through seat, said gasket apparatus comprising:

a head surface; and a gasket comprising:

an elastically deformable sealing element having an annular conformation about an axis, the elastically deformable sealing element configured to be set externally on said valve to co-operate both with said guide element and with said stem;

a supporting member having an annular conformation, which is set coaxially on at least a portion of said sealing element in such a way that the portion of the sealing element is pressed radially between said supporting member and said valve;

wherein said supporting member comprises a first component for interaction with said sealing element and a second component, said first component and said second component being distinct from one another, the second component comprising snap-action coupling means for coaxially mounting the first and second components together;

wherein said second component is set in a radially more external position with respect to said first component and defines a seat for receiving the first component;

wherein said snap-action coupling means comprise a plurality of engagement lances carried by said second component, which extend, in an undeformed condition, parallel to said axis and are elastically flexible away from and towards said first component for snap-action coupling to engage an upper contrast portion of the first component to prevent axial motion of said first component relative to said second component in a first axial direction; and wherein said second component comprises a substantially cylindrical main body comprising at least one axial contrast surface projecting radially inward to engage a lower contrast portion of the first component to prevent axial motion of said first component relative to said second component in a second axial direction opposite the first axial direction, and an annular flange, which projects radially outwards from one end of said main body and is in direct contact with said head surface of said internal-combustion, said engagement lances extending in cantilever fashion from an end of said main body opposite to said annular flange and being angularly distributed about said axis in a spaced apart manner such that a gap exists between adjacent ones of the lances.

2. The gasket apparatus according to claim 1, wherein said second component is made of plastic material.

3. The gasket apparatus according to claim 1, wherein said second component is made of plastic material and is designed to receive operating loads of said valve.

4. The gasket apparatus according to claim 1, wherein said first component has a substantially cylindrical conformation and an axial length, said first component surrounding said sealing element along the entirety of the axial length of the first component.

5. The gasket apparatus according to claim 2, wherein said first component is made of metal material.

6. The gasket apparatus according to claim 1, wherein said engagement lances are provided with retention teeth on free ends of the engagement lances, and wherein said upper contrast portion of the first component is defined by an edge which extends radially outwards.

7. The gasket apparatus according to claim 1, wherein said second component comprises a plurality of said axial contrast surfaces formed on a plurality of projections, the plurality of projections angularly distributed about said axis and project from said main body of said second component both radially inward and in a direction parallel to said axis to co-operate with said first component.

8. The gasket apparatus according to claim 7, wherein each said projection is angularly set between two of said engagement lances with respect to said axis.

9. The gasket apparatus according to claim 7, wherein said projections have, in a direction parallel to said axis, lengths shorter than the lengths of said engagement lances.

10. The gasket apparatus of claim 1 wherein the head surface is an annular depression delimited by an upstanding annular wall.

11. An internal combustion engine comprising the gasket apparatus of claim 1.

12. A gasket apparatus for sealing a valve of an internal-combustion engine, said valve comprising a guide element defining a through seat, and a stem slidably mobile in said through seat, said gasket apparatus comprising:

a gasket comprising:

an elastically deformable annular sealing element having an axis, the annular sealing element configured to be set externally on said valve to co-operate both with said guide element and with said stem;

an annular supporting member circumscribing at least a portion of said annular sealing element in such a way that the portion of the sealing element is pressed radially between said annular supporting member and said valve;

wherein said annular supporting member comprises a first annular component for interaction with said annular sealing element and a second annular component, said first annular component and said second annular component being distinct from one another, said second component circumscribing said first component and defining a seat in which the first component is located;

said second component comprising: (i) snap-action coupling means for coaxially mounting the first and second components together; (ii) at least one shoulder projecting radially inward, a lower contrast portion of the first component engaging the at least one shoulder to prevent axial motion of said first component relative to said second component in a first axial direction; and wherein said snap-action coupling means comprise a plurality of engagement lances carried by said second component, which extend, in an undeformed condition, parallel to said axis and are elastically flexible away from and towards said first component for snap-action coupling to engage an upper contrast portion of the first component to prevent axial motion of said first component relative to said second component in a first axial direction, said engagement lances angularly distributed about said axis in a spaced apart manner such that a gap exists between adjacent ones of the lances.

13. The gasket apparatus of claim 12 wherein said second component extends beyond said first component in said first axial direction.

14. The gasket apparatus of claim 12 wherein said at least one shoulder of said second component engages a lower edge of the said first component.

15. The gasket apparatus of claim 14 wherein said second component further comprises: (1) a substantially cylindrical main body, the at least one shoulder extending from the cylindrical main body; and (2) a flange extending radially outwards from cylindrical main body.

16. The gasket apparatus of claim 15 further comprising:

a head surface of the internal-combustion engine; and said flange of said second component being in direct contact with a head surface of said internal-combustion.

* * * * *